US006188772B1

(12) United States Patent
Norris et al.

(10) Patent No.: US 6,188,772 B1
(45) Date of Patent: Feb. 13, 2001

(54) ELECTROSTATIC SPEAKER WITH FOAM STATOR

(75) Inventors: Elwood G. Norris; James J. Croft, III, both of Poway, CA (US)

(73) Assignee: American Technology Corporation, San Diego, CA (US)

( * ) Notice: Under 35 U.S.C. 154(b), the term of this patent shall be extended for 0 days.

(21) Appl. No.: 09/105,380

(22) Filed: Jun. 26, 1998

Related U.S. Application Data

(63) Continuation-in-part of application No. 09/004,090, filed on Jan. 7, 1998.

(51) Int. Cl.[7] ..... H04R 25/00

(52) U.S. Cl. ..... 381/191; 381/116; 381/342; 381/176; 179/111 R; 179/180

(58) Field of Search ..... 367/170, 181; 179/111 R, 180; 381/116, 342, 176, 191

(56) References Cited

U.S. PATENT DOCUMENTS

| | | | | |
|---|---|---|---|---|
| 1,764,008 | * | 6/1930 | Crozier | 179/111 R |
| 1,799,053 | | 3/1931 | Mache . | |
| 1,809,754 | | 6/1931 | Steedle . | |
| 1,983,377 | | 12/1934 | Kellogg . | |
| 2,855,467 | | 10/1958 | Curry . | |
| 2,872,532 | | 2/1959 | Buchmann . | |
| 2,935,575 | | 5/1960 | Bobb . | |
| 2,975,243 | | 3/1961 | Katella . | |
| 2,975,307 | * | 3/1961 | Schroeder | 381/170 |
| 3,008,013 | * | 11/1961 | Williamson et al. | 381/170 |
| 3,136,867 | | 6/1964 | Brettell . | |
| 3,345,469 | * | 10/1967 | Rod | 381/169 |
| 3,373,251 | | 3/1968 | Seeler . | |
| 3,389,226 | | 6/1968 | Peabody . | |
| 3,544,733 | | 12/1970 | Reylek . | |
| 3,654,403 | | 4/1972 | Bobb . | |
| 3,674,946 | | 7/1972 | Winey . | |
| 3,787,642 | * | 1/1974 | Young | 179/111 R |
| 3,821,490 | | 6/1974 | Bobb . | |
| 3,829,623 | | 8/1974 | Willis . | |
| 3,833,771 | | 9/1974 | Collinson . | |
| 3,892,927 | * | 7/1975 | Lindenberg | 179/111 R |
| 3,919,499 | | 11/1975 | Winey . | |
| 3,941,946 | | 3/1976 | Kawakami . | |
| 3,997,739 | | 12/1976 | Kishikawa et al. . | |
| 4,160,882 | | 7/1979 | Driver . | |
| 4,210,786 | | 7/1980 | Winey . | |

(List continued on next page.)

OTHER PUBLICATIONS

Crandall, I.B. *Air–Damped Vibrating System: Theoretical Calibration of the Condenser Transmitter*, Phys. Rev., vol. 11 (1918) Pp. 449–460.

*Primary Examiner*—Curtis A. Kuntz
*Assistant Examiner*—Dionne Harvey
(74) *Attorney, Agent, or Firm*—Thorpe, North & Western, LLP

(57) ABSTRACT

An electrostatic speaker device, comprising a first foam stator having an interior surface, and a second foam stator having an interior surface positioned adjacent to the interior surface of the first stator. The interior surfaces of the first and second foam stators include electrically conductive cellular structure sufficiently small in cell size to develop a substantially continuous electrostatic charge dispersion across the respective first and second interior surfaces. At least one diaphragm is disposed between the first and second foam stators and includes an electrically conductive layer responsive to electrostatic forces developed by the respective first and second stators. An electrical charge is applied on the at least one diaphragm, along with electrical contacts coupled to the first and second foam stators for attachment to a signal source operable to supply voltage at the respective first and second stators to provide a push-pull drive configuration for the at least one diaphragm as an active speaker element.

53 Claims, 6 Drawing Sheets

U.S. PATENT DOCUMENTS

| | | | | |
|---|---|---|---|---|
| 4,289,936 | * | 9/1981 | Civitello | 179/111 R |
| 4,385,210 | | 5/1983 | Marquiss . | |
| 4,419,545 | | 12/1983 | Kuindersma . | |
| 4,471,172 | | 9/1984 | Winey . | |
| 4,480,155 | | 10/1984 | Winey . | |
| 4,550,228 | | 10/1985 | Walker et al. . | |
| 4,593,160 | | 6/1986 | Nakamura . | |
| 4,803,733 | | 2/1989 | Carver et al. . | |
| 4,885,781 | | 12/1989 | Seidel . | |
| 4,939,784 | | 7/1990 | Bruney . | |
| 5,054,081 | | 10/1991 | West . | |
| 5,392,358 | * | 2/1995 | Driver | 381/191 |
| 5,430,805 | | 7/1995 | Stevenson et al. . | |

* cited by examiner

ELECTROSTATIC SPEAKER WITH FOAM STATOR

This application is a continuation-in-part of previously filed co-pending patent application under Ser. No. 09/004,090 filed on Jan. 7, 1998, entitled Sonic Emitter with Foam Stator.

BACKGROUND OF THE INVENTION

1. Field of the Invention

This invention relates to the electrostatic speakers, and more particularly to electrostatic speakers which include a porous stator and are capable of full audio range performance.

2. Prior Art

Audio speakers typically fall within one of two categories: dynamic or magnetic driven devices and electrostatic speakers. Dynamic speakers rely on magnetic fields operating with respect to a moving cone and magnet that are driven by variable electromagnetic forces corresponding to the desired audio signal. Electrostatic speakers operate within much weaker, electrostatic force fields generated from a stationary stator which carries the audio signal and drives a conductive diaphragm suspended adjacent to the stator.

Electrostatic speakers have been available for decades; however, satisfactory high fidelity reproduction has been limited to very expensive systems, typically of large surface area. These limiting factors of high cost and cumbersome size have severely limited the consumer market for electrostatic speakers as part of a general sound reproduction system. This trend is contrasted by impressive advancements in dynamic speakers, both with reduction in cost and size. As a consequence, conventional dynamic speakers comprise 99% of the total domestic market. Electrostatic speakers constitute less than 1%.

The steady decline of cost of electronic components in other fields has not been matched by electrostatic design. To the contrary, these speakers remain extremely expensive. This is due in part to the large space requirement for electrostatic speakers. Because diaphragm displacement is extremely narrow, a large diaphragm is used to achieve an adequate displacement of air to develop desired amplitude, particularly at lower frequencies. In view of the required large diaphragm area, design and construction of drive systems and enclosures has tended to develop complexities in providing a uniform stator and corresponding diaphragm continuity.

One common element of electrostatic speakers is a rigid stator. The stator must be conductive to provide the variable voltage with attendant audio signal for driving the diaphragm. The rigidity of the stator is significant because the diaphragm must be maintained in a taut configuration to be fully responsive to the variations in electrostatic field strength carrying the audio signal. Any occurrence of non-uniformity in tension in the diaphragm may lead to nonlinear response in speaker output. Accordingly, the stator typically bears the stress of tension applied to the diaphragm.

Prior art stator elements have included rigid screens and grids, as well as perforated conductive plates. See, for example, U.S. Pat. No. 3,008,013 of Williamson et al and U.S. Pat. No. 3,892,927 of Lindenberg. Electrical contacts are provided on the stator for coupling leads from the voltage source. Perforations or open screen and grid structure enable passage of sound waves from the diaphragm to surrounding environment. This characteristic, referred to as acoustic transparency, imposes a significant limitation on the stator which conflicts with the need for uniform charge dispersion across the face of the stator. Uniform charge dispersion is favored because it provides continuity of force applied across the diaphragm. Lack of uniformity leads to reduction in efficiency in diaphragm response which limits audio output. Obviously, the ideal stator for charge distribution would comprise a flat plate without any form of opening or space interruption. This is impractical, however, because such a solid plate would block transmission of sound and defeat the purpose of the speaker.

Accordingly, the conflict between uniform charge dispersion and acoustic transparency arises with the need for open spaces or gaps in the stator to allow sound vibration to pass. These gaps constitute interruptions in the field continuity of charge distribution within the stator. In many prior art grid structures, such spacing was up to several centimeters in diameter. These large openings would clearly interrupt the uniformity of the electrostatic field. Preferred stators typically are formed of wire mesh having a woven matrix of conducting elements which have a continuously varying thickness, as well as grid openings in the several millimeter range. This configuration is illustrated in cross-section in FIG. 3 and represented in the disclosure of Rod in U.S. Pat. No. 3,345,469. It will be noted that large wire diameter is necessary to provide the strength to the grid needed for support of the diaphragm in tension. This size creates distance variations between the diaphragm and field source represented by h, h', h", etc. This difference is also a factor influenced by the opening size, which disturbs the uniformity of the field with increasing size.

Variations in openings sizes and shapes in stator plates is clearly shown in the various patents cited above. Such plates include molded or stamped perforations which range in dimensions up to several centimeters. Numerous complex configurations are illustrated for tensing or stretching the diaphragm across the stator to realize appropriate resonant frequencies needed for predictable sound reproduction.

Those skilled in the art will be familiar with other limitations within electrostatic speakers which have inhibited commercialization of systems which are cost competitive with conventional dynamic speakers. The previous discussion is simply for the purpose of demonstrating one particular area of technical difficulty which has challenged the electrostatic speaker industry. What is clear is that electrostatic speakers have been unable to keep pace with the continued expansive growth of dynamic speaker systems.

OBJECTS AND SUMMARY OF THE INVENTION

It is therefore an object the present invention to offer a new technology basis for electrostatic speakers which can provide the benefits of low cost, light weight, durability, and adaptability to a broad range of sizes, including small speaker systems useful as part of a computer or small television or stereo product.

It is also an object of the present invention to provide an electrostatic speaker which supplies a substantially continuous, uniform charge distribution across the stator, enabling high fidelity sound reproduction, while maintain acoustic transparency in the same structure.

It is a further object of this invention to provide an electrostatic speaker which offers full range of audio output with enhanced linearity within low frequency ranges.

Yet another object of this invention includes provision of an electrostatic speaker which is light in weight, yet able to produce commercially acceptable low frequency output.

These and other objects are realized in an electrostatic speaker device comprising a first fixed foam stator having an interior surface and a second fixed foam stator having an interior surface positioned adjacent to the interior surface of the first stator. At least one of these stators is acoustically transparent. The interior surfaces of the first and second foam stators are electrically conductive and have a small cellular structure which enables development of a substantially continuous electrostatic charge dispersion across the respective first and second interior surfaces. The diaphragm is disposed between the first and second foam stators, and includes an electrically conductive layer responsive to electrostatic forces developed by the respective first and second stators. An electrical charge is maintained on the diaphragm as a bias for cooperative operation with a supply voltage coupled to the respective first and second stators so as to create a push-pull drive configuration for the diaphragm as an active speaker element.

The stators may be further supported by opposing rigid grid members which form a protective backing to the foam stator. Acoustic transparency is preserved with a perforated grid structure, which may also be conductive to further enhance the electrostatic field strength. The use of two or more diaphragm members is disclosed, and includes a bias charge which repells the several diaphragm members from each other. A single diaphragm can be folded against itself to provide this multilayered structure. The diaphragms may be suspended between the respective stators, or may be supported directly on the stator surfaces. Various geometries are disclosed for adapting the systems for numerous directional and performance enhancements. Specific configurations of diaphragms are provided, including diaphragm structure having at least one diagonal without an applied tension to increase bass performance and to obtain substantially lower resonant frequencies. Flexible and compressible polymer foam are discussed in connection with stator construction for enhancing low frequency performance.

Other objects and features will be apparent to those skilled in the art, based on the following detailed description, taken in combination with the accompanying drawings.

DESCRIPTION OF THE PREFERRED EMBODIMENTS

Figure 1:
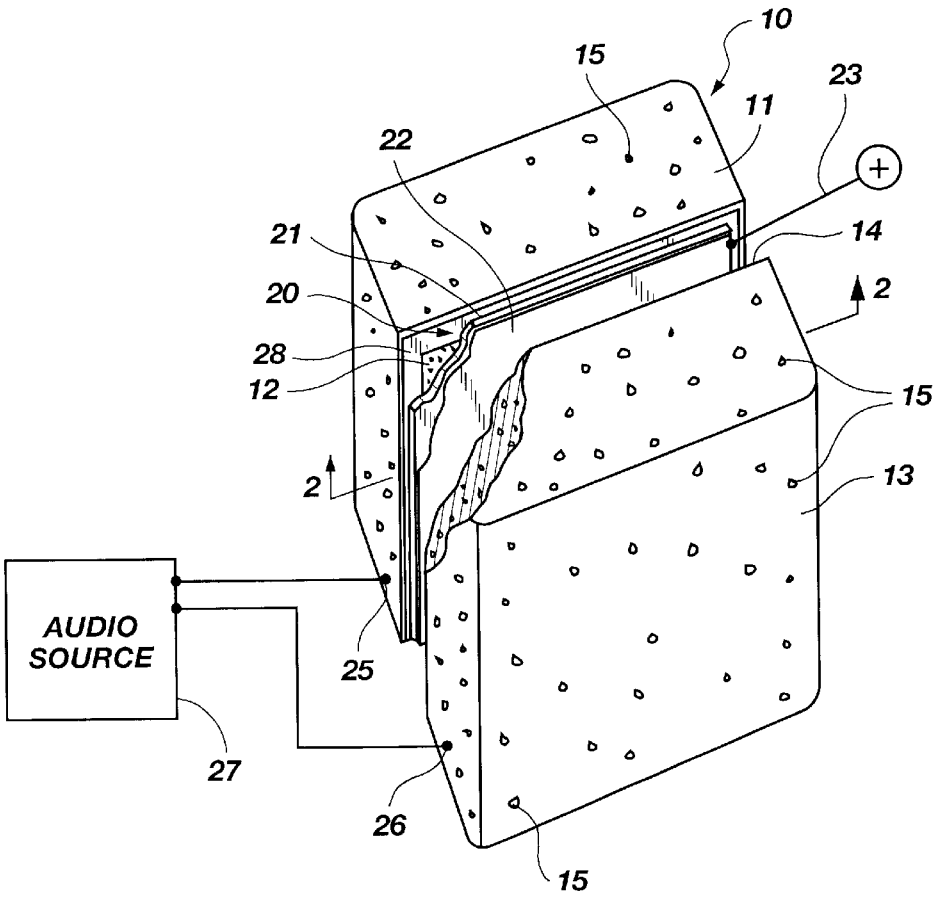
FIG. 1 shows an elevated perspective view of an electrostatic speaker constructed in accordance with the present invention.
Figure 2:
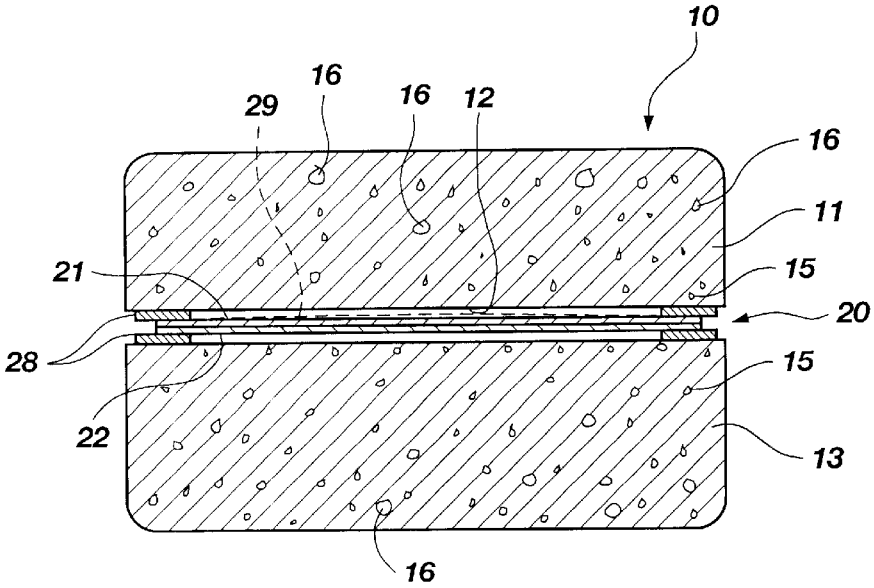
FIG. 2 illustrates a cross sectional view taken along the lines 2—2 of FIG. 1.

FIGS. 1 and 2 illustrate the basic construction of an electrostatic speaker using a compressible foam material as a stator member. It is important to note that the stator function requires this member to remain stationary while vibrating a flexible diaphragm for sound reproduction. Indeed, the term "stator" is derived from the same root term represented by this characteristic of stationary function. This quality has typically led to the selection of rigid plates to develop a stator which is stiff, and would logically discourage use of compressible, foamed polymers. Nevertheless, as is revealed herein, the soft foamed polymers offer unique properties which facilitate both uniform charge dispersion and acoustic transparency.

FIG. 1 shows an electrostatic speaker device 10 having a first foam stator 11 with an interior surface 12. A second foam stator 13 having a comparable interior surface 14 is positioned adjacent to the interior surface of the first stator. Both stator members 11 and 12 are comprised of conductive foam which enables the development of a charge capacitance between the respective interior faces 12 and 13. Specifically, the interior surfaces of the first and second foam stators are formed of an electrically conductive cellular structure sufficiently small in cell size to develop a substantially continuous electrostatic charge dispersion across the respective first and second interior surfaces.

Figure 3:
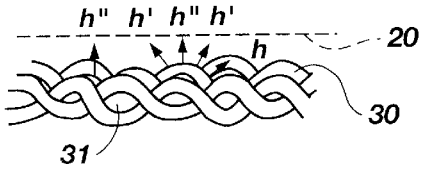
Fig. 3 (PRIOR ART)
FIG. 3 illustrates a wire grid stator of prior art design.
Figure 4:
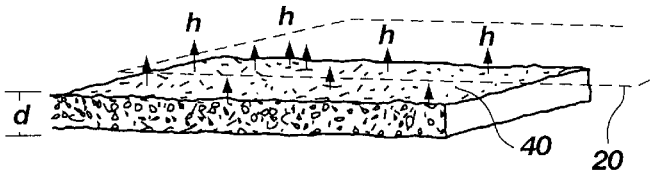
FIG. 4 shows a conductive foam stator in accordance with design parameters of the present invention.

The benefit of this conductive foam surface is represented in FIGS. 3 and 4. Whereas the wire grid structure 30 of FIG. 3 has open spaces 31 between wire interstices, the foam surface 40 operates as a substantially continuous surface. This is because the small cell structure enables charge dispersion around the cell structure, including across the cavity of the cell. Instead of experiencing an open gap without any charge density leading to differing field strengths h, h', h", etc., with respect to a diaphragm 20, the cell structure provides for continuous coverage of the surface area, with a generally common field strength h. At the same time, the cellular structure of the foam allows transmission of sound waves propagated at the diaphragm 20 to pass through the stator in accordance with desired speaker function. Accordingly, the conflicting properties of substantially uniform charge dispersion and acoustic transparency are realized in the same structure.

The size of individual cells will vary. Smaller cell structure 15 is positioned at the interior surfaces 12 and 14 to favor uniform charge dispersion. Larger cell structure 16 is possible toward the interior body and rearward portion, where uniform charge distribution is not so critical. In this region, foam thickness is needed for structural integrity and rigidity. A preferred range of dimensions for the small cell dimensions suitable for substantially uniform charge distribution is from 100 micrometers to 5 millimeters. Cell dimensions in the range of 0.25 mm to 1 mm have proved to be particularly effective to meet the requirements of the invention. Larger cell sizes are permissible to facilitate sound transmission and are typically at a distance from the diaphragm which does not interfere with field strength. It should be noted that a uniform small cell size can be maintained throughout the foam structure where reduction in polymer material is not a significant issue.

Numerous polymers are available which offer the properties of both conductivity and foam structure. As was disclosed in the parent application, computer packing foam provides these properties, and is also inexpensive. Compositions which are suitable include electrically conductive polyurethane foam. Foaming techniques are well known in the industry and will not be discussed in detail. Similarly, methods for modifying foams to a conductive state are well known. Stator thickness will vary depending upon the stiffness of the material and intended application. It is apparent that thicker dimensions will be required where the rigidity of the stator depends upon the stiffness of the foam stator. On the other hand, when used with a rigid grid, the foam may be very thin, simply to provide the desired uniform charge distribution at the surface. Typical dimensions will range from 1/16 inch up to several inches where a rigid grid is not used. Length and width dimensions are virtually unlimited because the foam stator will operate with the diaphragm in contacting relationship. Therefore, the diaphragm and surface of the stator can be molded or formed to conform to virtually any shape, thereby avoiding the problems previously associated with electrostatic speaker where delicate suspension of the diaphragm away from the stator surface was required. Field continuity at the diaphragm is automatically maintained by the uniform physical contact of the diaphragm at the stator interior surface.

The establishment of a charge capacitance between the respective interior faces of the stators enables use of at least one diaphragm 20 disposed between the first and second foam stators as a vibrating speaker element. The diaphragm 20 includes a dielectric layer 21 of material such as Kapton® or Mylar®, and an electrically conductive layer 22 responsive to electrostatic forces developed by the respective first and second stators. Multiple diaphragms may be used, as is disclosed hereafter. This diaphragm may be suspended between the stators 11 and 12, or may be positioned directly in contact with the conductive interior faces where the dielectric layer or other insulator is provided. A strip of insulation positioned around the perimeter of the diaphragm or stators will shield edges of the diaphragm and/or stators from arcing, The use of double sided adhesive tape may be used to fix the diaphragm in tension across the stator, as well as provide appropriate insulation at the perimeter. FIG. 2 shows the diaphragm suspended away from the interior stator surfaces, allowing larger displacement for low frequencies. Other embodiments herein illustrate the use of the diaphragm in direct contact with the stator. In this instance, the compressibility of the stator allows the diaphragm to distend slightly into the stator cell structure for low frequency response and/or higher sound pressure levels.

The operation of the illustrated charge capacitive device is comparable to electrostatic speaker systems. Accordingly, a charge source 23 for providing an electrical charge on the at least one diaphragm is provided for biasing the diaphragm. Other options include the use of precharged electret materials. In addition, electrical contacts 25 and 26 are coupled to the first and second foam stators for attachment to a signal source 27 operable to supply voltage at the respective first and second stators to provide a push-pull drive configuration for the at least one diaphragm as an active speaker element. These electrical components are well known in the industry.

Figure 5:
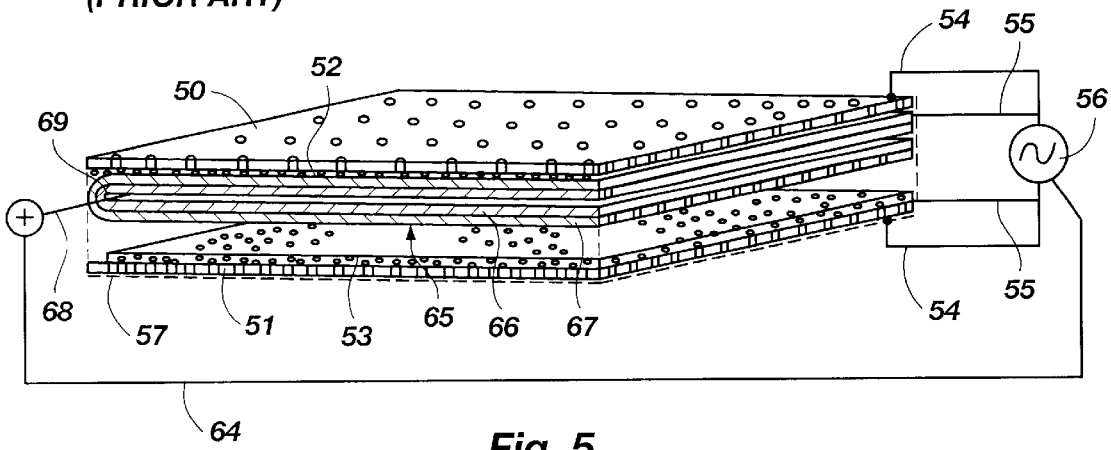
FIG. 5 illustrates a preferred embodiment of the present invention including rigid grid plates.

FIG. 5 illustrates an electrostatic speaker device which includes additional structure comprising first and second rigid grids 50 and 51 coupled to the respective first and second foam stators 52 and 53 to provide stiffening support. The stators may be adhesively or mechanically attached or simply compressed in position at the grids. These first and second grids may also be electrically conductive and include electrical contacts 54 and 55 for coupling between the signal source 56 to concurrently supply the voltage at both the respective first and second foam stators and the respective first and second grids to provide the push-pull drive configuration operable with respect to the at least one diaphragm. Where the exterior surface of the rigid grids are exposed to possible contact with a user, an insulative covering or layer 57 may be applied. With this conductive configuration, the field strength of signal applied from the stators 52 and 53 is complemented by additional voltage supplied to the conductive grids 50 and 51. This field strength increases as the operation of the diaphragm compresses the foam and moves even closer to the stronger field gradients.

FIGS. 2 and 5 present a significant option of the present invention to either suspend the diaphragm at a static distance from the stators as shown in FIG. 2, or apply the diaphragms in physical contact at the stators as represented in FIG. 5. This unique feature of the foam stator is possible because the cellular structure allows vibration of the diaphragm, despite partial contact at the surface. The presence of individual cells (some of which have exposed open cell structure) permits the diaphragm to oscillate in a uniform manner across the face of the stator. In a preferred embodiment where the foam is compressible, this movement is continuous across the full diameter of the diaphragm as it compresses the thin cellular surface structure contacting the diaphragm. Prior art grids and rigid structures clearly had less flexibility in this manner. The desire for smooth broadband response required the use of large openings in the stator plate, or separation of the diaphragm from the stator, with attendant suspension challenges.

Figure 6:
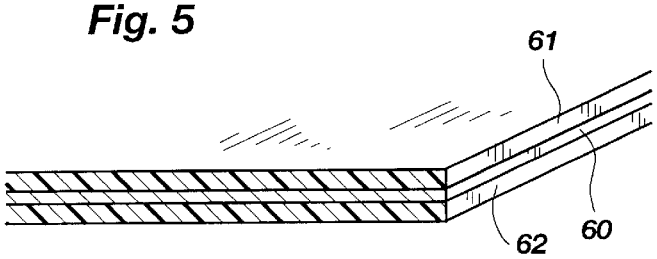
FIG. 6 illustrates a preferred embodiment of a diaphragm useful with the present invention.

As is illustrated in FIGS. 2 and 5, either single or multiple diaphragm members may be used as the vibrating speaker element. FIG. 6 shows a diaphragm comprised of a single electrically conductive layer 60 sandwiched between two opposing dielectric layers 61 and 62 which are integrally formed as a single diaphragm. The respective opposing dielectric layers provide insulative material between the conductive layer and the conductive foam stators. This construction provide significant versatility for either a suspended application, or diaphragm to be physically supported at a conductive stator face.

Figure 7:
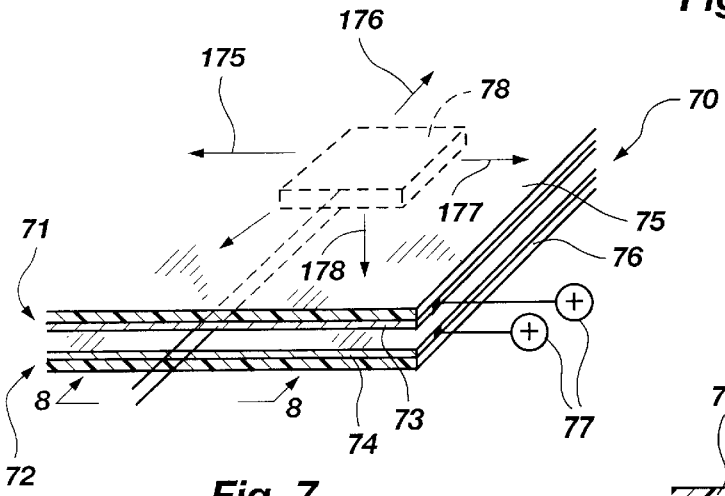
FIG. 7 comprises an elevated perspective view of another embodiment of the present invention.
Figure 8:
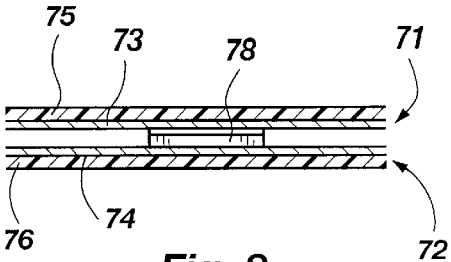
FIG. 8 shows a side view of the embodiment of FIG. 7, taken along the lines 8—8.

Another version shown in FIGS. 7 and 8 illustrates the diaphragm 70 as two separate diaphragms 71 and 72 each having a dielectric layer 73 and 74 and a conductive layer 75 and 76 applied to the dielectric layer. The two separate diaphragms 71 and 72 may be positioned with the conductive layers in juxtaposed, facing relationship, with the dielectric layers providing insulation of the conductive layer from the foam stators. This device includes means 77 for biasing the respective conductive layers in spaced apart relation during operation. A spacer element 78 is shown inserted for damping purposes, and also to provide for modifying the collective resonant frequency of the diaphragm as will be explained hereafter.

FIG. 5 illustrates an alternate diaphragm configuration wherein a single metalized Mylar® diaphragm 65 is used in combination with a biasing support wire 68. In this embodiment, the diaphragm comprises a metalized layer 66 which is in direct electrical contact with the bias wire 69. The outer Mylar® layer 67 provides insulation from the conductive stators 52 and 53. The biasing support wire 69 includes means 64 for coupling to a biasing circuit, which in this case includes a tap from the audio output signal. The biasing wire 68 provides an electrical contact positioned along and in physical contact with the common edge 69 of the continuous diaphragm. Specifically, the electrical contact comprises an exposed conductive element 68 which provides contact support for the folded conductive layer 69 of the single diaphragm 65 to thereby (i) provide a support member for the diaphragm to wrap around at the common edge, and (ii) establish electrical contact along the common edge to facilitate uniform charge dispersion on the diaphragm. It should be apparent that other diaphragm configurations are contemplated for use with the conductive foam stator as provided by this invention.

Figure 9:
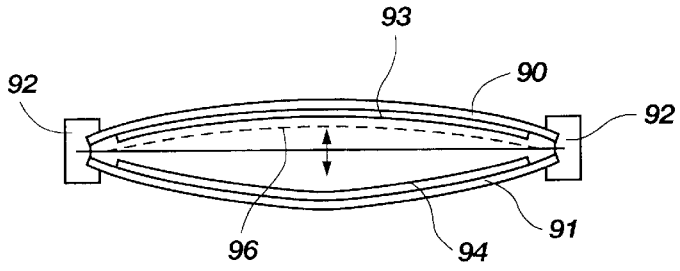
FIG. 9 graphically illustrates an additional embodiment of the present invention with a bowed configuration.

As previously mentioned, an advantage of the present invention is the versatility of the foam stators to be configured with a common geometric shape and are in substantial geometric alignment with the diaphragm and/or the opposing foam stator member. The previous figures have illustrated geometries wherein interior surfaces of the foam stators are generally planar and spaced apart and a substantially uniform distance. FIG. 9 shows a bowed configuration wherein the rigid grids 90 and 91 are fixed in a frame 92 in concave form, with the foam stators 93 and 94 attached at opposing grid faces. The diaphragm 95 is suspended between the stators. This embodiment offers maximum movement for the diaphragm as indicated at 96.

Figure 10:
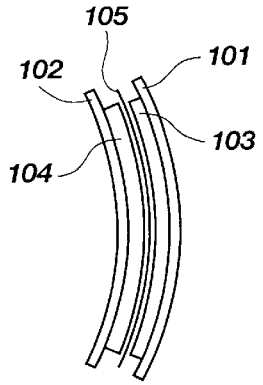
FIG. 10 graphically illustrates a concavo-convex construction of a further embodiment of this invention showing an end view diaphragm in curved configuration.
Figure 11:
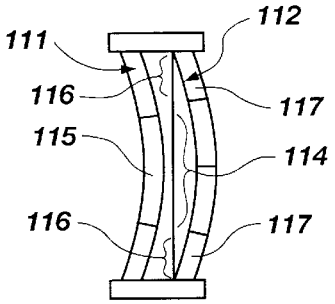
FIG. 11 graphically represents an end view of a further embodiment wherein the diaphragm is in a planar mode.

FIG. 10 depicts alternate geometry wherein the interior surfaces of the grid members 101 and 102 and attached foam stators 103 and 104 are respectively concave and convex in configuration and respectively in contact with opposing sides of the diaphragm 105. A further concavo-convex configuration is shown in FIG. 11 wherein the opposing stators 111 and 112 drive a diaphragm 113 which is suspended in planar mode. This embodiment introduces an aspect of selective driving of the diaphragm at desired audio ranges which differ along the diaphragm. For example, the central portion of the diaphragm 114 is driven by the most adjacent section 115 of the stator. The perimeter portions 116 of the diaphragm are activated by the corresponding sections 117 of the opposing stator. This allows the most proximate portions of the stators to operate with respect to the more favorable sections of (i) internal diaphragm for low frequencies and (ii) perimeter diaphragm for higher frequencies. Both stators may be made conductive at both frequency ranges to reinforce the more proximate stator action. These sculpted, curved geometries are configured to provide dispersion of sound in a radially expanding direction from the convex diaphragm. Similarly, the concave side of the speaker may be adapted to provide radially converging direction from the diaphragm toward a point of focus representing a prospective listener.

Figure 13:
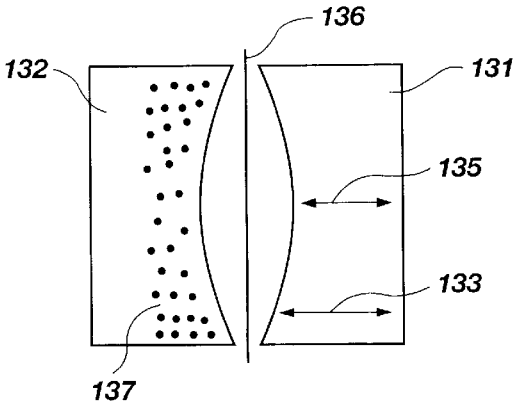
FIG. 13 illustrates a further embodiment of the present invention utilizing differential thicknesses of foam stator.
Figure 12:
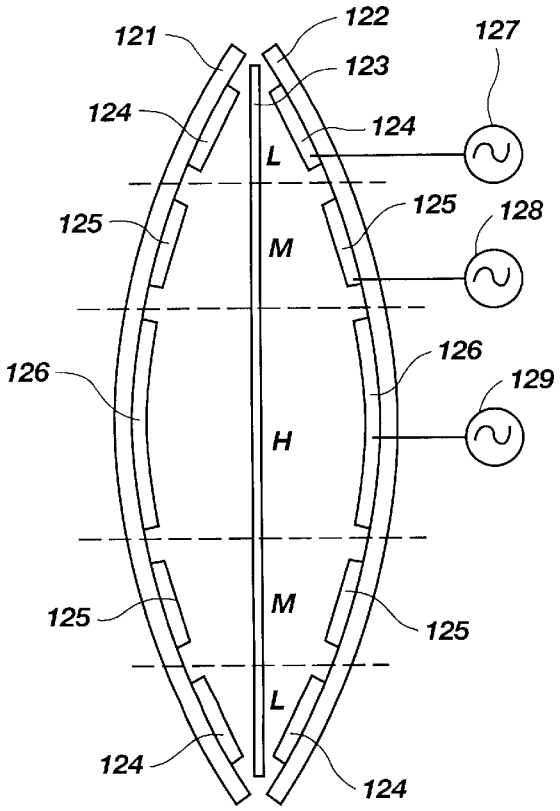
FIG. 12 provides a graphic illustration of the present invention utilizing multiple independent stators for influencing corresponding sectors of a diaphragm.

FIG. 11 illustrates the broad principle that the subject foam stator system having a rectangular configuration may be generally adapted wherein the static distance between the diaphragm and the respective foam stators is variable along the diaphragm in accordance with a predetermined sequence corresponding to different regions of frequency desired for the diaphragm. FIG. 12 shows a specific example wherein two opposing rigid plates (with perforations) 121 and 122 support an array of foam stators sized and physically configured for operation in selected band widths with respect to a single diaphragm 123. The stator members include a pair of low frequency drivers 124, midrange drivers 125 and higher frequency stators 126. These stators primarily influence corresponding sections of the diaphragm represented by L (low frequencies), M (midrange) and H (high bandwidth). In other words, the outer perimeter area H of the diaphragm is preselected for operation at frequencies of an upper audio range, whereas mid and low frequencies are allocated for internal areas M and L of the diaphragm. This also corresponds favorably with the static distance between the outer perimeter area and the foam stators, being less than the static distance between the internal areas and foam stators. A two component system with high and low frequency operation is also possible. This concept can also be implemented by varying the thickness of the foam stator structure of FIG. 1. For example, FIG. 13 shows two foam stators 131 and 132 which have been sculptured to have greater stator thickness at the perimeter section 133, and lesser thickness at the internal portions 135 to provide variable static distance between the diaphragm 136 and the foam stators for frequency differentiation. This control can also be incorporated with variations in stator density, such as at 137 wherein stators proximate to the outer perimeter of the at least one diaphragm have greater density than internal portions of the foam stators to provide higher resonant frequency response than a central portion of the foam stators.

It should also be noted that where the stator sectors are segregated as with elements 124, 125, and 126, and comprise component stator sections positioned juxtaposed to the diaphragm, respectively providing differing resonant frequencies in accordance with a predetermined sequence corresponding to different regions of resonant frequency desired for the diaphragm, segregated audio signals can also be provided. For example, each component stator section 124, 125, and 126 may be insulated from other component sections to divide the respective foams stators into segregated sections which operate independently. Independent audio drive circuitry 127, 128, and 129 is coupled to the respective component sections of the foam stators, each separate audio drive circuitry being tuned to a separate audio frequency range.

Figure 14:
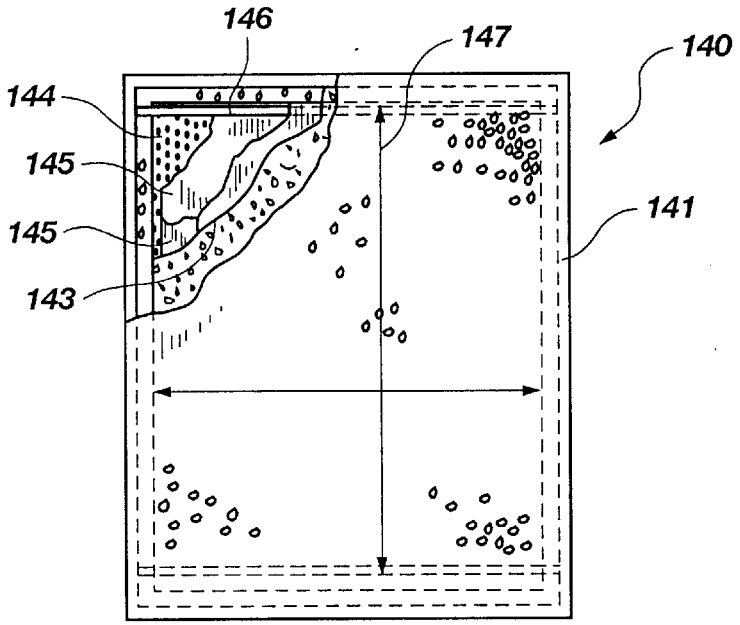
FIG. 14 shows a further embodiment of the present invention, including a diaphragm support mechanism for developing an unstressed diagonal along the diaphragm structure.
Figure 15:
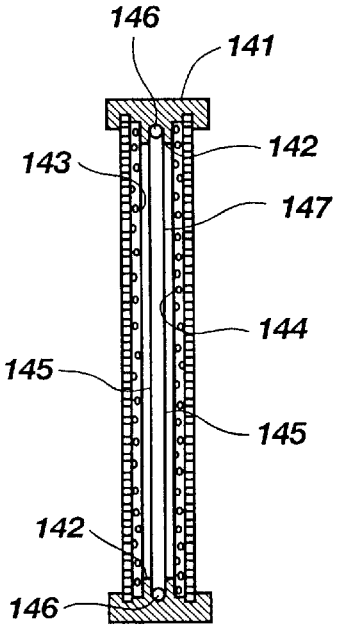
FIG. 15 represents a cross-sectional view taken along the lines 15—15 of FIG. 14.
Figure 16:
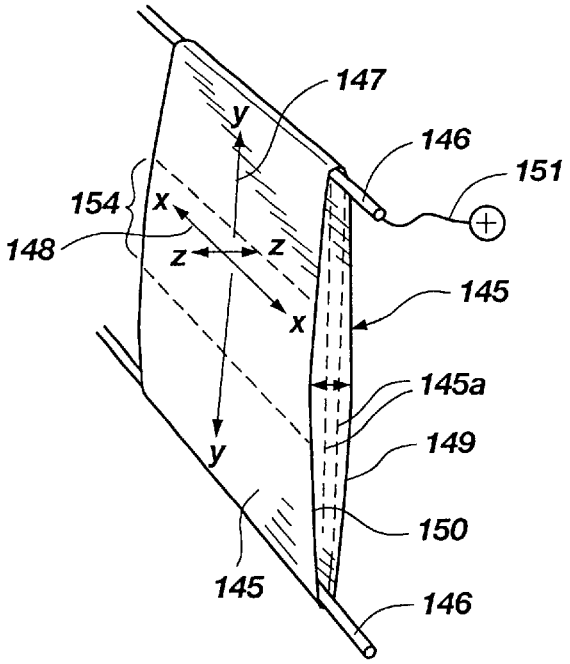
FIG. 16 graphically illustrates the supported diaphragm of FIG. 15, isolated from the remaining support structure.

In addition to the use of differentiating sections of stator and diaphragm, resonant frequency of the diaphragm can be modified by a technique of eliminating tension along a given diagonal. For example, FIGS. 14 through 16 illustrate an electrostatic speaker device 140, further comprising an insulative frame portion 141 extending around an interior perimeter 142 at the respective interior surfaces 143 and 144 the first and second foam stators. A conductive diaphragm 145 is suspended in tension between opposing support members 146 so that tension is applied along the vertical orientation 147. No tension is applied along the perpendicular axis 148, thereby allowing the diaphragm to distend **145*a* at its opposing side edges 149 and 150 with audio signal forces developed by the stators. This nonstressed aspect of the diaphragm permits significant reduction in the resonant frequency of the diaphragm, greatly enhancing the low frequency range. A bias charge 151 urges the respective edges 149 and 150 apart to prevent contact therebetween. Adequate separation distance between the respective stator members avoids adverse contact at the interior stator faces. Accordingly, the diaphragm is able to develop full extension at the edges 149 and 150, similar as occurs with a central portion of the diaphragm. Gripping structure associated with the frame 141** is attached to the first and second grid for maintaining the spaced orientation and supporting the diaphragm therebetween.

The concept of an unstressed diagonal of diaphragm can be applied along multiple orientations, depending upon the resonant frequency desired. The simplest form of implementation of this principle is an x-y-z system, wherein the tension force is directed solely along the y axis, leaving the x axis without stress. Maximum movement in the z axis is thereby enabled for the central section of the diaphragm 154. Those skilled in the art will appreciate that other orientations and diagonal combinations may be applied to accomplish similar purposes. Accordingly, at least a portion of the perimeter of the diaphragm is in an unstressed condition along at least one diameter across the diaphragm. The rectangular configuration of the speaker device 140 is a preferred shape for application of this unstressed factor. Specifically, a rectangle having two opposing edges of the diaphragm clamped in tension, and a remaining two opposing edges unclamped and without transverse tension between the unclamped opposing edges enables movement of a full width of the diaphragm including the unclamped edges for enhancement of low frequencies.

Figure 17:
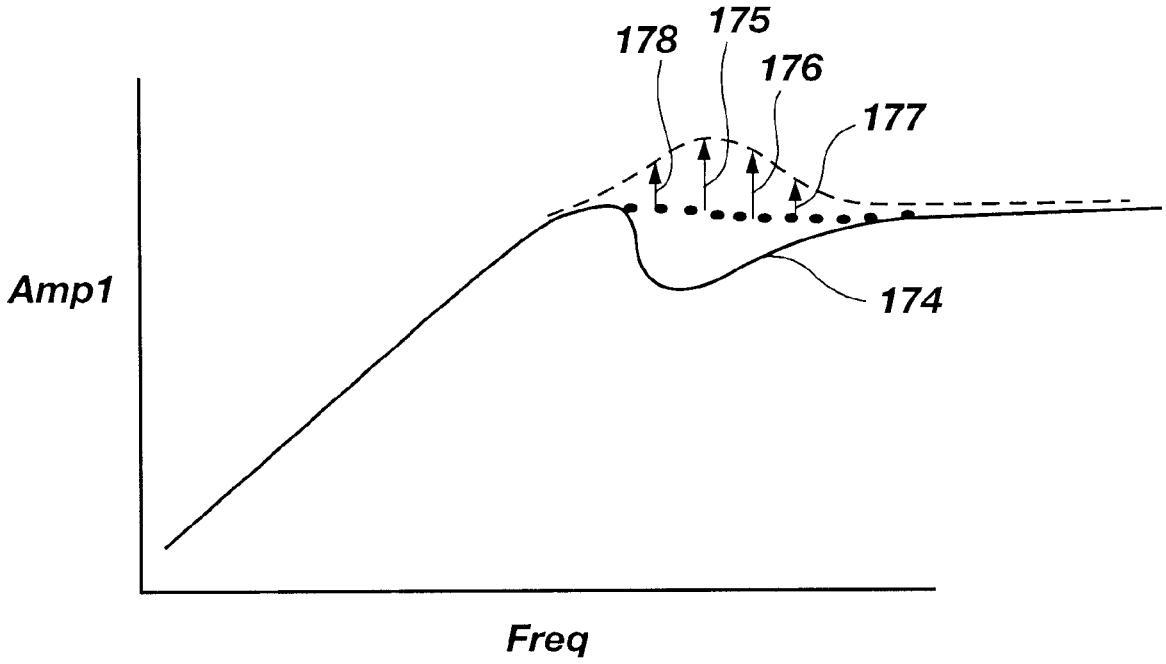
FIG. 17 graphically illustrates equalization of low range audio output based on use of a damping member isolated within a surrounding section of diaphragm.

Another useful technique for modifying resonant frequency for the subject invention involves application of a damping insert as shown in FIGS. 7 and 8. Whereas prior art techniques have segmented and isolated sections of diaphragm to develop different resonant frequencies, the present invention integrates a variety of different resonant frequencies by permitting 360 of free diaphragm movement around the damping element 78. Instead of relying on independent diaphragm sectors to equalize bass roll-off, the present invention develops an interdependent relationship wherein the full diaphragm acts like a drum head, having varying tension around the perimeter of the insert. The diaphragm is literally tuned to enhance lost bass signal by incorporating several interdependent resonant frequencies as shown in FIG. 17. For illustration only, the orientations 175, 176, 177, and 178 represent a selection of numerous interdependent resonant frequencies which cooperate to minimize bass loss 174 represented on the graph of FIG. 17, such as occurs with bass roll off.

Figure 18:
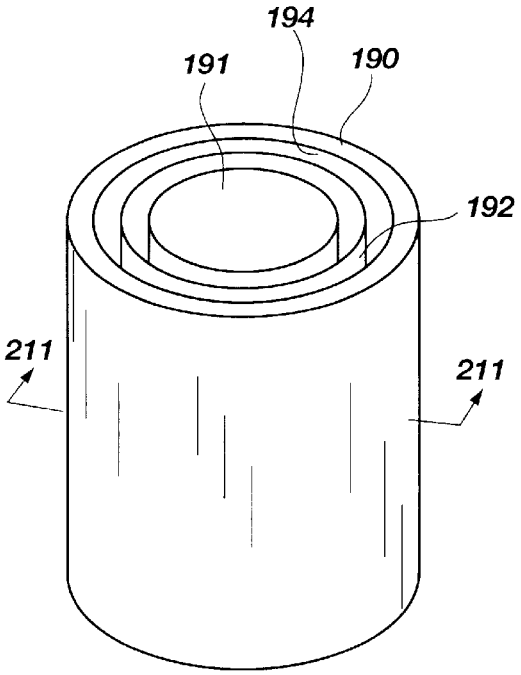
FIG. 18 illustrates an elevational view of a speaker system comprising concentric cylinders.

The polarity and insulative sides of the foam members may be reversed so that the forward face of the foam is insulated, and the emitter film contacting face is conductive. Such a device is illustrated in FIG. 18 as a cylindrical speaker. The device comprises an electrostatic emitter film 192 which is responsive to an applied variable voltage to emit sonic output based on a desired sonic signal. A first foam member 190 having a forward face, an intermediate core section and a rear face as described above is positioned on the exterior and includes open cell structure to transmit sound. The first foam member including a composition having sufficient stiffness to support the electrostatic film and including conductive properties which enable application of a variable voltage to supply the desired sonic signal. The first forward face 194 comprises a surface including small cavities having surrounding wall structure defining each cavity, the surrounding wall structure terminating at contacting edges approximately coincident with the forward face of the foam member. This forward face 194 has a coating of insulative material to prevent arcing from the voltage within the intermediate foam section and the film 192. A second foam member 191 of comparable configuration in opposing orientations is provided to complement the push-pull construction. This foam may be partial open cell and partial closed cell to dampen rearward sound transmission. An insulation barrier be provided on an adjacent side of the film (metalized surface), or at the second forward face of the stator 191. Sound propagation would therefore be oriented radiated outward from the cylinder, reinforced by the dynamic affect of both stator elements. Insulating means is positioned between the electrostatic emitter film and the conductive composition of the first foam member which has the conducive properties.

Figure 19:
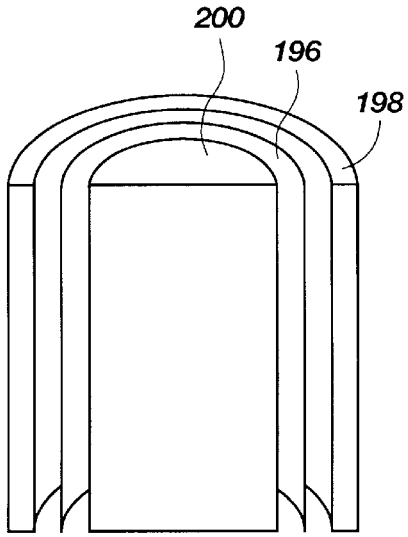
FIG. 19 is a cross sectional view taken along the lines 11—11 of FIG. 18.

A variation of the foam member would be a more general support member as shown in FIG. 19. In this embodiment, the device includes an electrostatic emitter film 196 responsive to a variable voltage to emit sonic output based on a desired sonic signal. A support member 198 having a forward face, an intermediate core section and a rear face is formed of a conductive material which includes a forward face composed of a composition having sufficient stiffness to support the electrostatic film and including conductive properties which enable application of a variable voltage to the forward face to supply the desired sonic signal. The forward face comprises a generally pitted surface including small cavities having surrounding wall structure defining each cavity, said surrounding wall structure terminating at a contacting edges approximately coincident with the forward face of the support member. This may be in the form of a metal or expanded metal material which operates in a manner similar to the foam structure. Here again, the conductive and insulative surfaces could be reversed as explained above. A push-pull configuration is provided by the second support member 200.

Figure 20:
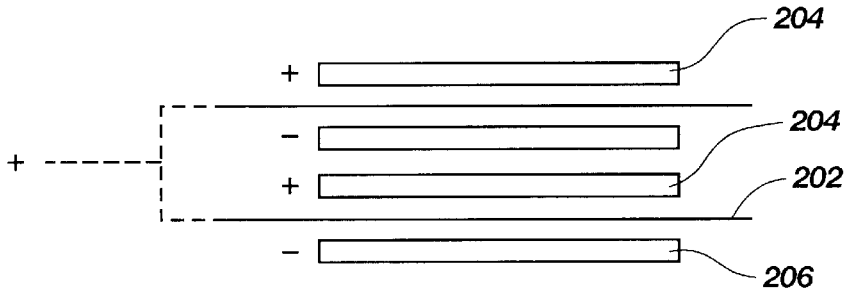
FIG. 20 graphically depicts a multilayered speaker array of alternating stators and emitter films.

FIG. 20 illustrates the use of multiple emitter film 202, sandwiched between foam or general support members 204, 206. Each additional emitter film will add approximately 3 db output to the emitted sonic signal. It will be apparent that numerous configurations can be adapted within this multiple combination pattern.

It will be apparent to those skilled in the art that the foregoing description of preferred embodiments is not intended to limit other applications of the inventive principles disclosed herein. For example, FIGS. 18–21 represent other geometric shapes that can be formed as an electrostatic speaker. Accordingly, other variations will be apparent and are intended to be comprehended within the following claims.

We claim:

1. An electrostatic speaker device, comprising:

a first foam stator having an interior surface;

a second foam stator having an interior surface positioned adjacent to the interior surface of the first stator, at least one of said first and second foam stators being acoustically transparent;

said interior surfaces of the first and second foam stators including electrically conductive cellular structure sufficiently small in cell size to develop a substantially continuous electrostatic charge dispersion across the respective first and second interior surfaces;

at least one diaphragm disposed between the first and second foam stators, said diaphragm including an electrically conductive layer responsive to electrostatic forces developed by the respective first and second stators in push-pull operation;

means for providing an electrical charge on the at least one diaphragm; and electrical contacts coupled to the first and second foam stators for attachment to a signal source operable to supply voltage at the respective first and second stators to provide a push-pull drive configuration for the at least one diaphragm as an active speaker element.

2. An electrostatic speaker device as defined in claim 1, further comprising first and second rigid grids coupled to the respective first and second foam stators to provide stiffening support, said first and second grids being electrically conductive and including electrical contacts for coupling between the signal source to concurrently supply the voltage at both the respective first and second foam stators and the respective first and second grids to provide the push-pull drive configuration operable with respect to the at least one diaphragm.

3. An electrostatic speaker device as defined in claim 1, wherein the first and second foam stators comprise flexible foam material and the first and second grids are mechanically attached at respective exterior surfaces of the foam stators opposite from the respective interior surfaces to provide rigid support to the flexible foam material.

4. An electrostatic speaker device as defined in claim 3, wherein the flexible foam material is bonded to the respective first and second rigid grids to form composite first and second stators each comprising a rigid conductive backing and a compressible foam interior conductive surface.

5. An electrostatic speaker device as defined in claim 2, wherein the interior surfaces of the respective first and second grids are electrically conductive and exterior surfaces of the respective grids are nonconductive.

6. An electrostatic speaker device as defined in claim 1, wherein the first and second foam stators have a thickness within a range of approximately 1/16th inch to 1 inch.

7. An electrostatic speaker device as defined in claim 1, wherein the diaphragm is sandwiched between and in physical contact with the respective first and second foam stators.

8. An electrostatic speaker device as defined in claim 7, wherein the cellular structure is compressible in response to contact forces of the diaphragm with the first and second foam stators.

9. An electrostatic speaker device as defined in claim 1, wherein the diaphragm is spaced at a static distance from the respective first and second foam stators to enable dynamic oscillation of the diaphragm without contact interference with the interior surfaces of the foam stators.

10. An electrostatic speaker device as defined in claim 1, wherein the at least one diaphragm comprises a single electrically conductive layer sandwiched between two opposing dielectric layers which are integrally formed as a single diaphragm, said respective opposing dielectric layers providing insulative material between the conductive layer and the conductive foam stators.

11. An electrostatic speaker device as defined in claim 1, wherein the at least one diaphragm comprises two separate diaphragms each having a dielectric layer and a conductive layer applied to the dielectric layer; said two separate diaphragms being positioned with the conductive layers in juxtaposed, facing relationship, said dielectric layers providing insulation of the conductive layer from the foam stators, said device including means for biasing the respective conductive layers in spaced apart relation during operation.

12. An electrostatic speaker device as defined in claim 11, wherein the respective conductive layers include electrical contacts for coupling to a biasing circuit for applying a biasing signal of common polarity to repel the conductive layers to the spaced apart relation.

13. An electrostatic speaker device as defined in claim 12, further comprising audio circuitry coupled to the respective foam stators to provide audio signal for driving the two diaphragms to generate audio compression waves, said device further comprising biasing means coupled between the audio circuitry and the respective two diaphragms for extracting voltage from the audio signal as the biasing signal.

14. An electrostatic speaker device as defined in claim 11 wherein the means for biasing the respective conductive layers in spaced apart relation further comprises a direct current power source which is electrically coupled at a first terminal and a second terminal to each of the respective conductive layers to thereby apply a charge having a same polarity to thereby cause the respective conductive layers to repel each other.

15. An electrostatic speaker device as defined in claim 11, wherein the two separate diaphragms are formed of a single diaphragm comprising a conductive layer and a dielectric layer, said single diaphragm being centrally folded upon itself to form a common edge of continuous diaphragm, said conductive layers being juxtaposed in face to face configuration.

16. An electrostatic speaker device as defined in claim 15, wherein the electrical contacts for coupling to a biasing circuit comprise an electrical contact positioned along and in physical contact with the common edge of the continuous diaphragm.

17. An electrostatic speaker device as defined in claim 16, wherein the electrical contact comprises an exposed conductive element which provides contact support for the folded conductive layer of the single diaphragm to thereby (i) provide a support member for the diaphragm to wrap around at the common edge, and (ii) establish electrical contact along the common edge to facilitate uniform charge dispersion on the diaphragm.

18. An electrostatic speaker device as defined in claim 1, further comprising an insulating layer positioned between the electrically conductive surface of the at least one diaphragm and the first and second foam stators.

19. An electrostatic speaker device as defined in claim 1, wherein the foam stators are configured with a common geometric shape and are in substantial geometric alignment.

20. An electrostatic speaker device as defined in claim 19, wherein interior surfaces of the foam stators are generally planar and spaced apart and a substantially uniform distance.

21. An electrostatic speaker device as defined in claim 19, wherein the interior surfaces are respectively concave and convex in configuration and respectively in contact with opposing sides of the at least two diaphragms.

22. An electrostatic speaker device as defined in claim 19, wherein the interior surfaces are respectively concave and convex in configuration and are spaced in non-contacting relationship with opposing sides of the at least one diaphragm.

23. An electrostatic speaker device as defined in claim 22, wherein the at least one diaphragm is substantially planar in configuration, one side of the at least one diaphragm being more proximate to the convex configuration of the interior surface than to the concave configuration.

24. An electrostatic speaker device as defined in claim 19, wherein the geometries are configured to provide dispersion of sound in a radially expanding direction from the at least one diaphragm.

25. An electrostatic speaker device as defined in claim 1, wherein the foam stators are sculpted to form curved geometries at the interior surfaces, said device further including support structure for positioning the at least one diaphragm against the curved geometries wherein the interior surface supports the at least one diaphragm and allows the at least one diaphragm to conform to the same curved geometries.

26. An electrostatic speaker device as defined in claim 25, wherein the sculpted, curved geometries are configured to provide dispersion of sound in a radially expanding direction from the at least one diaphragm.

27. An electrostatic speaker device as defined in claim 25, wherein the sculpted, curved geometries are configured to provide propagation of sound in a radially converging direction from the at least one diaphragm toward a point of focus representing a prospective listener.

28. An electrostatic speaker device as defined in claim 9, wherein the static distance between the at least one diaphragm and the respective foam stators is variable along the at least one diaphragm in accordance with a predetermined sequence corresponding to different regions of resonant frequency desired for the diaphragm.

29. An electrostatic speaker device as defined in claim 28, wherein an outer perimeter area of the at least one diaphragm is preselected for operation at frequencies of an upper audio range, whereas mid and low frequencies are allocated for internal areas of the at least one diaphragm, said static distance between the outer perimeter area and the foam stators being less than the static distance between the internal areas and foam stators.

30. An electrostatic speaker device as defined in claim 29, wherein foam stators proximate to the outer perimeter of the at least one diaphragm have greater thickness than internal portions of the foam stators and provide lesser static distance between the at least one diaphragm and the foam stators.

31. An electrostatic speaker device as defined in claim 29, wherein foam stators proximate to the outer perimeter of the at least one diaphragm have greater density than internal portions of the foam stators and provide higher resonant frequency response than a central portion of the foam stators.

32. An electrostatic speaker device as defined in claim 9, wherein the respective foam stators comprise component stator sections positioned juxtaposed to the at least one diaphragm and respectively providing differing resonant frequencies in accordance with a predetermined sequence corresponding to different regions of resonant frequency desired for the diaphragm.

33. An electrostatic speaker device as defined in claim 32, wherein each component stator section is insulated from other component sections to divide the respective foams stators into segregated sections which operate individually on separate signal sources.

34. An electrostatic speaker device as defined in claim 33, wherein the component sections are comparatively sized to correspond to different audio frequency ranges, smaller sizes being allocated for higher frequencies and larger sizes being allocated to lower frequencies.

35. An electrostatic speaker device as defined in claim 34, further comprising audio drive circuitry coupled to the electrical contacts of the foam stator to supply a desired audio signal.

36. An electrostatic speaker device as defined in claim 35, wherein separate audio drive circuitry is coupled to the respective component sections of the foam stators, each separate audio drive circuitry being tuned to a separate audio frequency range.

37. An electrostatic speaker device as defined in claim 2, further comprising:

an insulative frame portion extending around an interior perimeter at the respective interior surfaces of the first and second rigid grids;

said at least one electrostatic diaphragm having a conductive layer sandwiched between the first and second rigid grids and having a diaphragm perimeter positioned between respective insulative frame portions of the grid, said diaphragm including an insulative layer between the conductive layer and the interior conductive surfaces of the first and second grids; and gripping structure attached to the first and second grid for maintaining the spaced orientation and supporting the diaphragm therebetween.

38. A device as defined in claim 1, wherein at least a portion of a perimeter of the at least one diaphragm is in an unstressed condition along at least one diameter across the diaphragm.

39. A device as defined in claim 38, wherein the at least one diaphragm is configured as a rectangle having two opposing edges of the diaphragm clamped in tension, and a remaining two opposing edges unclamped and without transverse tension between the unclamped opposing edges to thereby enable movement of a full width of the at least one diaphragm including the unclamped edges for enhancement of low frequencies.

40. An electrostatic speaker device, comprising:

a foam stator having opposing exterior surfaces and acoustic transparency over an operating frequency range of the device;

said exterior surfaces including electrically conductive cellular structure sufficiently small in cell size to develop a substantially continuous electrostatic charge dispersion across the respective exterior surfaces;

at least one diaphragm disposed adjacent each exterior surface, said diaphragm including an electrically conductive layer responsive to electrostatic forces developed by the stator;

means for providing an electrical charge on the at least one diaphragm; and electrical contacts coupled to the foam stator for attachment to a signal source operable to supply voltage at the exterior surfaces of the stator to provide a push-pull drive configuration for the at least one diaphragm as an active speaker element.

41. An electrostatic speaker device as defined in claim 40, wherein the at least one diaphragm is in physical contact with the exterior surface of the foam stator.

42. An electrostatic speaker device as defined in claim 41, wherein the cellular structure is compressible in response to contact forces of the diaphragm with the foam stator.

43. An electrostatic speaker device as defined in claim 40, wherein the at least one diaphragm is spaced at a static distance from the foam stator to enable dynamic oscillation of the diaphragm without contact interference with the exterior surface of the foam stator.

44. An electrostatic speaker device as defined in claim 40, wherein the conductive layer includes electrical contacts for coupling to a biasing circuit for applying a biasing signal.

45. An electrostatic speaker device, comprising:

a first rigid grid which is substantially acoustically transparent;

a second rigid grid spaced from an interior surface of the first grid;

a first foam stator supported at the interior surface of the first grid;

a second foam stator supported at an interior surface of the second grid and facing the interior surface of the first grid, at least one of said first and second foam stators being acoustically transparent;

said first and second foam stators including electrically conductive cellular structure at respective faces of each foam stator most proximate to the diaphragm wherein the cellular structure is sufficiently small in cell size to develop a substantially continuous electrostatic charge dispersion across the respective first and second foam stators;

at least one diaphragm disposed between the first and second foam stators, said diaphragm including an electrically conductive layer responsive to electrostatic forces developed on the respective first and second stators;

means for providing an electrical charge on the at least one diaphragm; and electrical contacts coupled to the first and second foam stators for attachment to a signal source operable to supply voltage at the respective first and second stators to provide a push-pull drive configuration for the diaphragm as an active speaker element.

46. An electrostatic speaker device as defined in claim 45, further comprising an insulating layer positioned between the electrically conductive surface of the at least one diaphragm and the first and second foam stators.

47. An electrostatic speaker device, comprising:

a first rigid grid which is substantially acoustically transparent;

a second rigid grid spaced from an interior surface of the first grid;

a first foam stator supported at the interior surface of the first grid;

a second foam stator supported at an interior surface of the second grid and facing the interior surface of the first grid;

at least one of said first and second foam stators being acoustically transparent and including electrically conductive cellular structure at respective faces of each foam stator most proximate to the diaphragm wherein the cellular structure is sufficiently small in cell size to develop a substantially continuous electrostatic charge dispersion across the respective first and second foam stators;

at least one diaphragm disposed between the first and second foam stators, said diaphragm including an electrically conductive layer responsive to electrostatic forces developed on the respective first and second stators;

means for providing an electrical charge on the at least one diaphragm; and electrical contacts coupled to the first and second foam stators for attachment to a signal source operable to supply voltage at the respective first and second stators to provide a push-pull drive configuration for the diaphragm as an active speaker element.

48. An electrostatic speaker device, comprising:

a first compressible foam stator which is substantially acoustically transparent;

a second compressible foam stator having an electrically conductive interior surface spaced from an electrically conductive interior surface of the first stator;

an insulative frame portion extending around an interior perimeter at the respective interior surfaces of the first and second rigid grids;

at least one electrostatic diaphragm having a conductive layer sandwiched between the first and second foam stators and having a diaphragm perimeter positioned for push-pull operation between respective insulative frame portions of the grid, said diaphragm including an insulative layer between the conductive layer and the interior conductive surfaces of the first and second grids;

gripping structure attached to the first and second grid for maintaining the spaced orientation and supporting the diaphragm therebetween; and electrical contacts positioned on the respective first and second rigid grids and the conductive layer of the diaphragm for coupling to a signal source for providing an audio signal capable of imposing a push-pull electrostatic force field on the diaphragm to drive audio output from the diaphragm between the respective first and second grids.

49. A device as defined in claim 48, further comprising a clamping structure at opposing edges of the diaphragm to maintain the diaphragm in sufficient tension between the first and second rigid grids to enable propagation of audio pressure waves.

50. A device as defined in claim 49, wherein the clamping structure is applied to a first set of opposing edges of the diaphragm, remaining edges of the diaphragm being unclamped to permit responsive displacement of the diaphragm to the electrostatic force field from the respective first and second grids.

51. A device as defined in claim 50, wherein the diaphragm is configured as a rectangle having two opposing edges of the diaphragm clamped in tension, and a remaining two opposing edges unclamped and without transverse tension between the unclamped opposing edges to thereby enable movement of the unclamped edges with an interior section of the diaphragm.

52. An electrostatic speaker device, comprising:

a first foam stator having an interior conductive surface;

a second foam stator positioned adjacent to the first stator at least one of said first and second foam stators being acoustically transparent;

a first rigid grid which is substantially acoustically transparent;

a second rigid grid having an electrically conductive interior surface in substantially juxtaposed orientation and spaced a preselected distance from an electrically conductive interior surface;

at least two electrostatic diaphragms sandwiched between the first and second rigid grids and having a diaphragm perimeter positioned for push-pull operation between respective insulative frame portions of the grids, said diaphragms including conductive surfaces which are juxtapose from each other and separated from the conductive surfaces of the first and second grids by an insulative layer of the diaphragm;

gripping structure attached to the first and second grid for maintaining the parallel and spaced orientation and supporting the diaphragm therebetween;

a damping member inserted between the two electrostatic diaphragms, said damping member being fully surrounded by open diaphragm space to enable interdependent modification of resonant frequency of the surrounding diaphragm through 360 degrees; and electrical contacts positioned on the respective first and second rigid grids for coupling to a signal source for providing an audio signal capable of imposing a push-pull electrostatic force field on the diaphragm to drive audio output from the diaphragm between the respective first and second grids.

53. A device as defined in claim 52, wherein the two electrostatic diaphragms comprise a single sheet of diaphragm material folded against itself to form a double sheet configuration.

* * * * *